US008388402B2

(12) United States Patent
Fielding, Jr.

(10) Patent No.: US 8,388,402 B2
(45) Date of Patent: Mar. 5, 2013

(54) SUBMERSIBLE WATER TOY AND RELATED METHOD OF USE

(76) Inventor: Jerry Fielding, Jr., Brighton, MI (US)

( * ) Notice: Subject to any disclaimer, the term of this patent is extended or adjusted under 35 U.S.C. 154(b) by 0 days.

(21) Appl. No.: 13/176,158

(22) Filed: Jul. 5, 2011

(65) Prior Publication Data

US 2011/0263170 A1 Oct. 27, 2011

Related U.S. Application Data

(63) Continuation of application No. 10/989,939, filed on Nov. 16, 2004, now abandoned, which is a continuation-in-part of application No. 10/695,320, filed on Oct. 28, 2003, now abandoned.

(60) Provisional application No. 60/461,569, filed on Apr. 9, 2003, provisional application No. 60/527,588, filed on Dec. 5, 2003.

(51) Int. Cl.
*A63H 23/10* (2006.01)
*A63H 23/00* (2006.01)

(52) U.S. Cl. ..... 446/153; 441/65

(58) Field of Classification Search ..... 446/153–156, 446/160, 161; 441/65, 67, 74, 79; 472/129
See application file for complete search history.

(56) References Cited

U.S. PATENT DOCUMENTS

| | | | | | |
|---|---|---|---|---|---|
| D152,673 | S | * | 2/1949 | Clark | D21/769 |
| D157,564 | S | * | 3/1950 | Byerly | D21/769 |
| D187,677 | S | * | 4/1960 | Hollington | D21/770 |
| D203,365 | S | * | 12/1965 | Heston, Jr. | D21/803 |
| 3,655,211 | A | * | 4/1972 | Bollettieri et al. | 280/609 |
| 3,870,006 | A | * | 3/1975 | Hashimoto | 114/121 |
| 4,020,782 | A | * | 5/1977 | Gleason | 114/55.58 |
| 4,028,761 | A | * | 6/1977 | Taylor | 441/65 |
| D258,516 | S | * | 3/1981 | Slingerland | D21/769 |
| 4,331,340 | A | | 5/1982 | Bolen | |
| D265,116 | S | * | 6/1982 | Churchill | D21/770 |
| 4,386,982 | A | * | 6/1983 | Weinhaus | 156/79 |
| 4,619,619 | A | * | 10/1986 | Muse, Jr. | 441/65 |
| 4,850,914 | A | * | 7/1989 | Cox | 441/65 |
| 4,871,337 | A | * | 10/1989 | Harris | 441/70 |
| D305,145 | S | * | 12/1989 | Shanelec | D21/769 |
| 4,929,208 | A | * | 5/1990 | Corica | 441/75 |
| 4,990,113 | A | * | 2/1991 | Morrison | 441/75 |
| D323,691 | S | * | 2/1992 | Olson | D21/770 |
| 5,154,655 | A | * | 10/1992 | Glydon | 441/75 |
| D330,747 | S | * | 11/1992 | Pia | D21/769 |
| 5,167,552 | A | * | 12/1992 | Johnson, III | 441/74 |
| 5,234,638 | A | * | 8/1993 | Jang | 264/45.4 |
| 5,273,470 | A | | 12/1993 | Sneddon et al. | |
| 5,308,271 | A | * | 5/1994 | Foulke | 441/74 |
| 5,435,765 | A | * | 7/1995 | Fletcher | 441/74 |
| 5,544,919 | A | * | 8/1996 | Tinkler | 280/809 |
| 5,605,111 | A | * | 2/1997 | Culpepper | 114/315 |
| 5,647,784 | A | * | 7/1997 | Moran | 441/65 |
| 5,802,642 | A | * | 9/1998 | Slaughter | 5/656 |
| 5,846,108 | A | * | 12/1998 | Milford | 441/67 |
| D403,501 | S | * | 1/1999 | Winter | D3/211 |

(Continued)

FOREIGN PATENT DOCUMENTS

JP 2000-335484 12/2000

OTHER PUBLICATIONS

Overton's Catalog 1992, p. 4, 'Slammer Trick Board' and Velocity Ski Board, located on the left side of page.

(Continued)

*Primary Examiner* — Kien Nguyen

(57) ABSTRACT

A submersible water toy for stunt based activities includes a main body portion constructed of a buoyant material. The main body portion defines an upper deck surface upon which the user can stand or otherwise be supported. The buoyancy of the main body portion is such that at least a portion of the user's weight is supported when used in a pool or other body of water.

17 Claims, 6 Drawing Sheets

U.S. PATENT DOCUMENTS

| | | | | |
|---|---|---|---|---|
| D408,067 | S * | 4/1999 | McGarry | D21/760 |
| 5,947,788 | A * | 9/1999 | Derrah | 446/154 |
| D422,136 | S * | 4/2000 | Barrick, V | D3/211 |
| 6,059,308 | A * | 5/2000 | Baudin et al. | 280/610 |
| 6,189,912 | B1 * | 2/2001 | Ritzinger | 280/609 |
| D448,441 | S * | 9/2001 | Wolf | D21/760 |
| 6,290,249 | B1 * | 9/2001 | Wolf | 280/609 |
| D448,704 | S | 10/2001 | Goble | |
| D457,587 | S * | 5/2002 | Wolf | D21/760 |
| 6,402,578 | B1 * | 6/2002 | Zappitelli | 441/129 |
| D463,908 | S * | 10/2002 | Bergfalk | D3/211 |
| 6,461,210 | B2 * | 10/2002 | Lorenzo | 441/68 |
| D473,907 | S * | 4/2003 | Eckert | D21/766 |
| D473,908 | S * | 4/2003 | Eckert | D21/766 |
| 6,779,478 | B1 * | 8/2004 | Esposito | 114/357 |
| D501,905 | S * | 2/2005 | Ellis | D21/765 |
| 6,863,014 | B2 * | 3/2005 | Hudson et al. | 114/347 |
| 6,908,351 | B2 * | 6/2005 | Burke | 441/65 |
| D528,605 | S * | 9/2006 | Lee | D20/10 |
| 7,134,990 | B2 * | 11/2006 | Wischusen | 482/148 |
| D536,760 | S | 2/2007 | Fielding, Jr. | |
| 7,247,026 | B1 * | 7/2007 | Ellis | 434/247 |
| 2001/0019198 | A1 * | 9/2001 | Wolf | 280/609 |
| 2002/0018345 | A1 | 2/2002 | Seifert et al. | |
| 2002/0121752 | A1 * | 9/2002 | Gille et al. | 280/18 |
| 2002/0121765 | A1 * | 9/2002 | Wolf | 280/609 |
| 2003/0151215 | A1 * | 8/2003 | Stief et al. | 280/14.21 |
| 2003/0193170 | A1 * | 10/2003 | Gille et al. | 280/609 |
| 2004/0032113 | A1 * | 2/2004 | Rancon et al. | 280/609 |
| 2004/0203315 | A1 * | 10/2004 | Fielding, Jr. | 446/153 |
| 2005/0064781 | A1 * | 3/2005 | Fielding, Jr. | 446/153 |
| 2006/0082089 | A1 * | 4/2006 | Rejtano | 280/87.042 |

OTHER PUBLICATIONS

International Search Report for PCT/US04/10740, mailed on Dec. 23, 2004, 3 pages.

Office Action for U.S. Appl. No. 10/989,939, mailed on Feb. 21, 2006, 4 pages.

Office Action for U.S. Appl. No. 10/989,939, mailed on Nov. 20, 2006, 5 pages.

Office Action for U.S. Appl. No. 10/989,939, mailed on Jun. 4, 2007, 6 pages.

Final Office Action for U.S. Appl. No. 10/989,939, mailed on Nov. 15, 2007, 7 pages.

Office Action for U.S. Appl. No. 10/989,939, mailed on Apr. 1, 2009, 6 pages.

Final Office Action for U.S. Appl. No. 10/989,939, mailed on Oct. 22, 2009, 7 pages.

Office Action for U.S. Appl. No. 10/989,939, mailed on Apr. 27, 2010, 8 pages.

Final Office Action for U.S. Appl. No. 10/989,939, mailed on Jan. 4, 2011, 7 pages.

* cited by examiner

SUBMERSIBLE WATER TOY AND RELATED METHOD OF USE

CROSS-REFERENCE TO RELATED APPLICATIONS

This application is a continuation of U.S. patent application Ser. No. 10/989,939, filed Nov. 16, 2004, and entitled "Submersible Water Toy and Related Methods of Use," which claims priority to U.S. Provisional Application No. 60/527,588 filed Dec. 5, 2003 and which is a continuation-in-part of U.S. patent application Ser. No. 10/695,320, filed Oct. 28, 2003, and entitled "Submersible Water Toy and Related Method of Use" (now abandoned), which claims priority to U.S. Provisional Application No. 60/461,569, filed on Apr. 9, 2003. Each of the above-identified applications is hereby incorporated by reference in its entirety.

FIELD OF THE INVENTION

The present invention relates generally to aquatic devices. More particularly, the present invention relates to a submersible water toy for buoyantly support a portion of the user's weight when used in a pool, ocean, lake or other body of water.

BACKGROUND OF THE INVENTION

Various types of competition and recreation relating to stunt-based activities have recently experienced increased popularity. While this popularity is not age limited, most of the popularity has been with children and young adults. These competitions and recreational activities include both aquatic activities and land based activities. Participants in these activities generally ride on equipment and perform stunts of various difficulty based on their experience level.

The aquatic competitions and recreational activities include water skiing. As is well known, the water skier is pulled behind a boat and performs various maneuvers ranging from passing back and forth across the boat wake to flips and jumps. A related aquatic activity involves the use of a kneeboard.

The land based activities include snow skiing and snow boarding. The skiers and boards use gravity to perform tricks on snow covered hills. The land based activities also include skate boarding and roller blading that involve aerial and other stunts.

While all of these known activities have appreciated a significant increase in popularity, they are all associated with limitations and/or disadvantages insofar as the present invention is concerned. For example, many of the known activities require adult participation, such as in the form of boat driving for water skiing and knee boarding. Other of the activities require expensive equipment. Still yet other activities require mountains or sizable hills and snow conditions.

Thus, it remains a need in the art to provide a submersible water toy for stunt based activities that overcomes the disadvantages and limitations associated with the known prior art.

SUMMARY OF THE INVENTION

It is a general object of the present invention to provide a submersible water toy for stunt based activities that overcomes the disadvantages and limitations associated with known equipment for stunt based activities, including but not limited to those disadvantages and limitations discussed above.

It is another object of the present invention to provide a submersible water toy for stunt based activities that is relatively inexpensive to manufacture.

It is another object of the present invention to provide a submersible water toy for stunt based activities that can be used by a single person.

It is another object of the present invention to provide a submersible water toy for stunt based activities that allows the user to perform stunts of varying difficulty.

It is another object of the present invention to provide a submersible water toy for stunt based activities that buoyantly supports a portion of the user's weight when used in a pool.

It is a more particular object of the present invention to provide a submersible water toy for stunt based activities that is constructed primarily of foam.

In one particular form, the present invention provides a submersible water toy for stunt based activities. The submersible water toy includes a main body portion constructed of a buoyant material. The main body portion defines an upper deck surface upon which the user can stand. The buoyancy of the main body portion is such that at least a portion of the user's weight is supported when used in a pool or other body of water.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE EMBODIMENTS

The following description of the embodiments of the present invention is merely exemplary in nature and is in no way intended to limit the invention, its application, or uses.

Figure 1:
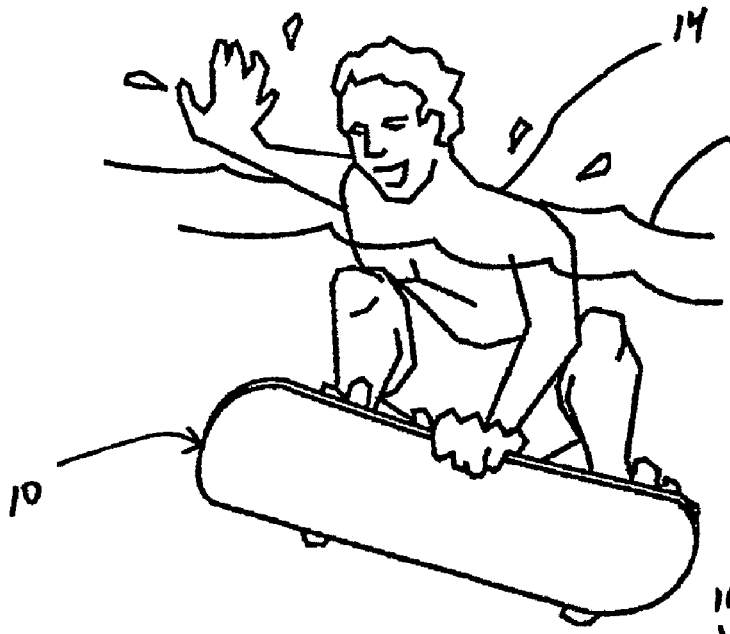
FIG. 1 is an environmental view of a submersible water toy constructed in accordance with the teachings of a first embodiment of the present invention, the submersible water toy shown operatively associated in a pool and with a user.

With initial reference to the environmental view of FIG. 1, a submersible water toy constructed in accordance with the teachings of a first embodiment of the present invention is illustrated and generally identified at reference 10. The water toy 10 is shown submersed in a pool of water 12. It will be understood by those skilled in the art that the teachings of the present invention are equally applicable for oceans, lakes or other bodies of water. A user 14 is shown positioned on the submersible water toy 10.

Figure 2:
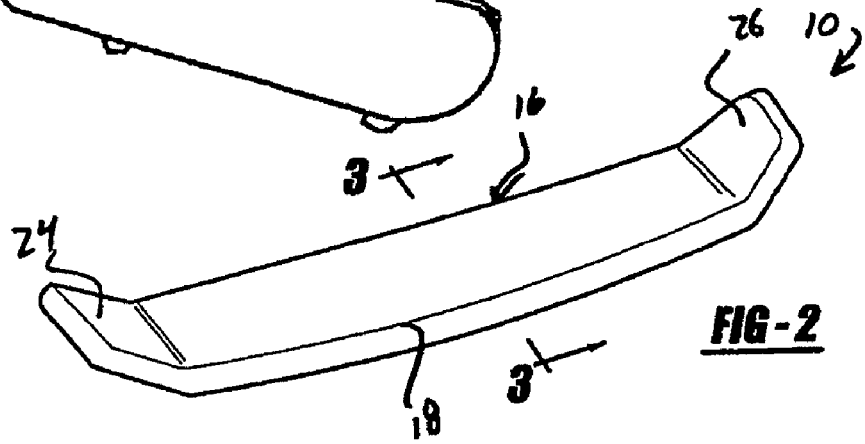
FIG. 2 is an enlarged perspective view of the submersible water toy of FIG. 1.
Figure 3:
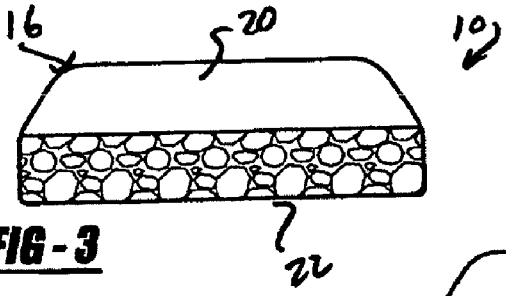
FIG. 3 is a cross-sectional view taken along the line 3-3 of FIG. 2.

With continued reference to the environmental view of FIG. 1 and additional reference to FIGS. 2 and 3, the submersible water toy 10 of the first embodiment of the present invention will be further described. The submersible water toy 10 may include a core or main body portion 16. The core 16 may be constructed of a foam material. In one particular application, the core 16 is constructed of ethylene vinyl acetate. In other applications, the core can be constructed of expanded polystyrene foam. Those skilled in the art will readily appreciate that various other types of materials can be employed within the scope of the present invention. The toy 10 may be formed to include a silk cover and a woven polypropylene layer below the cover. The water toy 10 may also be constructed to include a top and bottom surface of neoprene. In certain applications, it may be desirable to incorporate a plastic skeleton for strength considerations.

The toy 10 may be formed to include a silk cover and a woven polypropylene layer below the cover. The water toy 10 may also be constructed to include a top and bottom surface of neoprene.

The main body portion 16 is shown to include a central section or portion 18 having an upper surface 20 and a lower surface 22. The upper surface 20 defines a deck portion for directly supporting the feet of the user 14 (see FIG. 1, for example). The lower surface 22 is buoyantly supported by the water.

As most particularly shown in FIG. 2, the submersible water toy 10 may include cantilevered front and rear ends 24 and 26 which angle upwardly as they extend from the center portion 18. These angled front and rear ends 24 and 26 provide alternate surfaces for engaging the feet of the user 14 as the user performs various stunts. The submersible water toy 10 of the present invention may be alternatively constructed without these angled front and rear ends 24 and 26.

In one particular application, the submersible water toy 10 has an ethylene vinyl acetate core and a length of approximately 31 inches, a width of approximately 8 inches and a thickness of approximately 2 inches. In another particular application, the submersible water toy 10 has an expanded polystyrene core and a length of 29 inches, a width of 8 inches and a thickness of 2 inches. These dimensions, however, are merely exemplary. In this regard, the dimensions can be modified depending on factors including but not limited to the buoyancy of the particular material incorporated to construct the toy; the weight of the intended user; and the particular stunts or tricks intended to be performed on the toy. Based on all these factors, an optimal design of the submersible water toy 10 provides enough buoyancy to support at least a portion of the user's weight.

As shown in the environmental view, the user 14 is supported while performing a stunt such that the water level is at his chest. In most applications, the buoyancy of the submersible water toy 10 is low enough that larger children and adults will be able to pin the toy 10 to the pool bottom while in shallow water. The size of the toy 10 can be modified to accommodate different user weights. Without the user 14, the toy will float to the surface of the pool 12 for easy retrieval.

Figure 4:
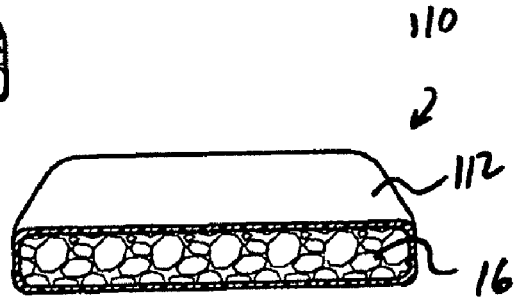
FIG. 4 is a cross-sectional view similar to FIG. 3, illustrating an alternative construction for the submersible water toy of the present invention.

Turning now to the cross-sectional view of FIG. 4, a second alternative construction of a submersible water toy constructed in accordance with the teachings of the present invention is illustrated and generally identified at reference character 110. The submersible water toy 110 is similarly constructed to the toy 10 of the preferred embodiment to include a foam core 16. Distinct from the preferred embodiment, the submersible water toy 110 additionally includes a plastic shell 112. The plastic shell 112 provides additional strength and increases the useful life of the toy 110. The remainder of the details of the submersible water toy 110 will be understood to be similar to those details described above in connection with the preferred embodiment.

Figure 5:
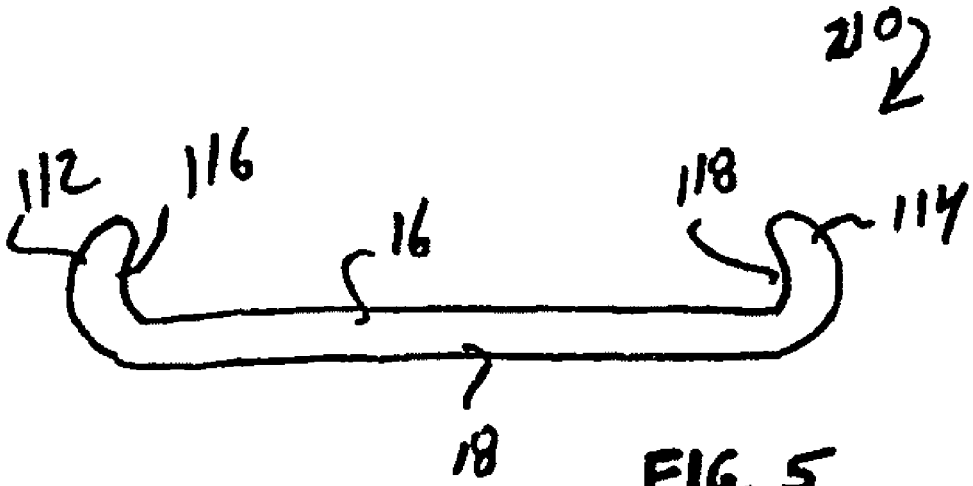
FIG. 5 is a side view of a submersible water toy constructed in accordance with the teachings of a second embodiment of the present invention.

Turning now to FIG. 5, a second embodiment of a submersible water toy constructed in accordance with the teachings of the present invention is illustrated and generally identified at reference character 210. Again, the submersible water toy 210 is similarly constructed to the toy 10 of the preferred embodiment to include a foam core 16. Distinct from the first embodiment, the submersible water toy 110 additionally includes front and rear ends 112 and 114 that inwardly and upwardly curve as they extend from the main body portion 18. The curved ends 112 and 114 define convex surfaces 116 and 118, respectively, for opposing the sides of the feet of the user 10. These surfaces may facilitate the performance of particular tricks or stunts by the user 10. The remainder of the details of the submersible water toy 210 will be understood to be similar to those details described above in connection with the preferred embodiment.

Figure 6:
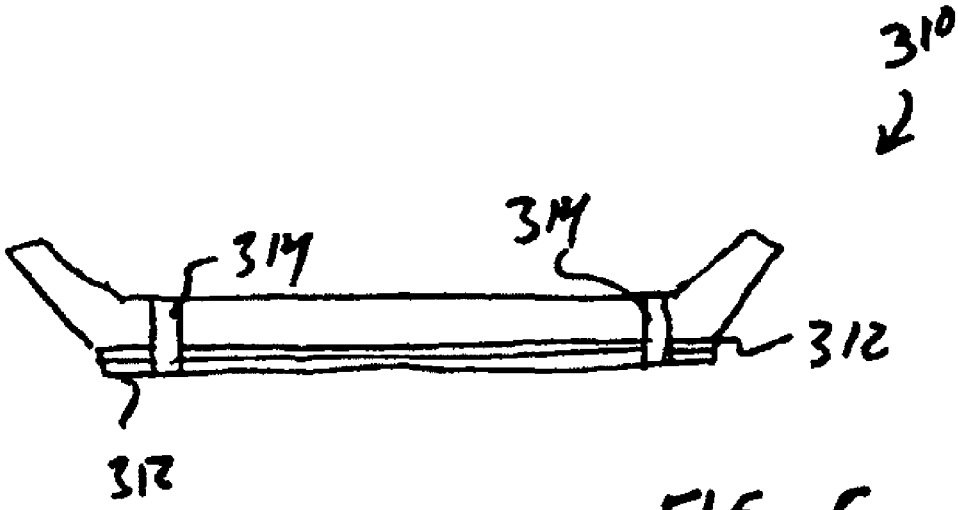
FIG. 6 is a side view of a submersible water toy constructed in accordance with the teachings of a third embodiment of the present invention.

Turning now to FIG. 6, a third embodiment of a submersible water toy constructed in accordance with the teachings of the present invention is illustrated and generally identified at reference character 310. In this particular embodiment, the submersible water toy 310 of the present invention is modified to be able to readily accommodate users of various sizes. As noted above, one critical aspect of the present invention allows the user to be suitably supported within the water for the performance of tricks or stunts. The submersible water toy 310 includes a main body portion 18 that is similar to that described above. The submersible water toy 310 further includes a plurality of buoyant panels 312 that may be selectively attached to the main body portion 18 depending on the particular buoyancy required of the toy 310. In the embodiment illustrated, the submersible water toy 310 is shown to include two (2) panels 312. Those skilled in the art will appreciate that any particular number of panels may be incorporated within the scope of the present invention. The panels 312 are removably secured to the main body portion 18 with elastic bands 314. Alternative manners of releasably attaching the panels 312 may also be employed.

Figure 7:
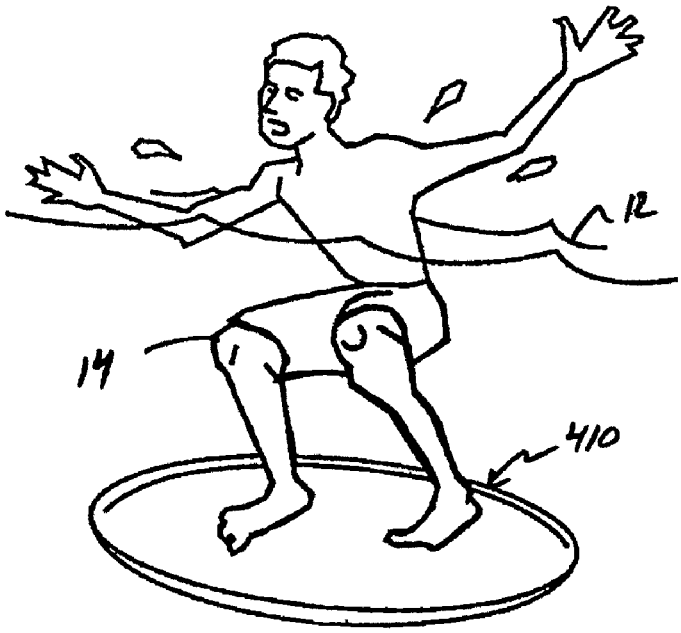
FIG. 7 is an environmental view of a submersible water toy constructed in accordance with the teachings of a fourth embodiment of the present invention, the submersible water toy shown operatively associated in a pool and with a user.

Turning now to FIG. 7, a fourth embodiment of a submersible water toy constructed in accordance with the teachings of the present invention is illustrated and generally identified at reference character 410. In this particular embodiment, the submersible water toy 410 is shown to be generally circular or disk-shaped.

Figure 8:
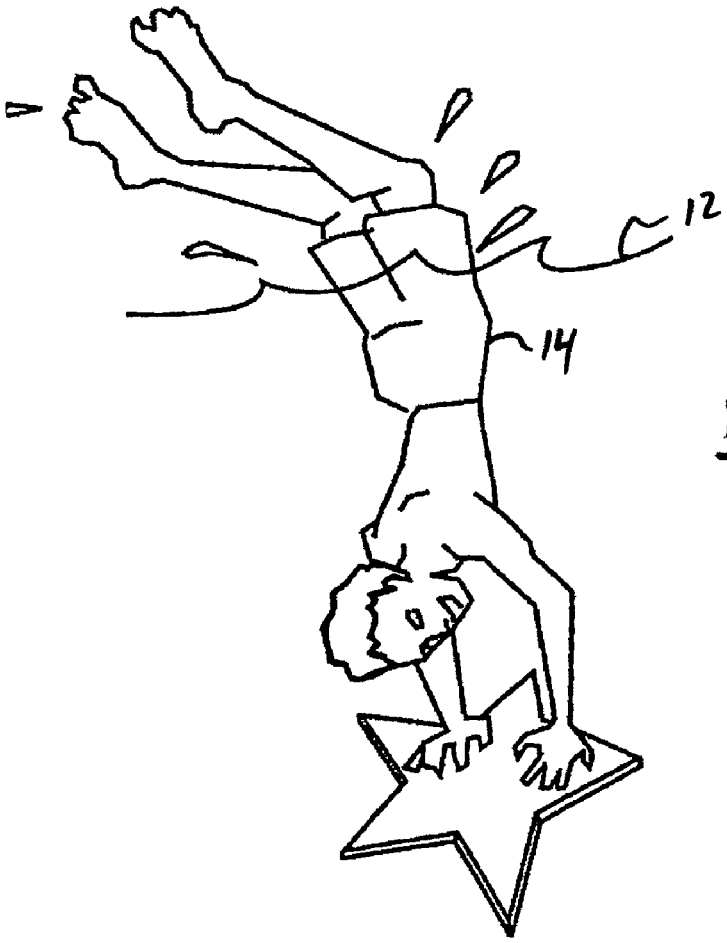
FIG. 8 is an environmental view of a submersible water toy constructed in accordance with the teachings of a fifth embodiment of the present invention, the submersible water toy shown operatively associated in a pool and with a user.

Turning now to FIG. 8, a fifth embodiment of a submersible water toy constructed in accordance with the teachings of the present invention is illustrated and generally identified at reference character 510. In this particular embodiment, the submersible water toy 510 is shown to be generally star-shaped. In the environmental view illustrated, the user is shown performing a hand plant. It will be clear to those skilled in the art that the submersible water toy 510 and the other embodiments disclosed herein can be used for both standing stunts and hand stunts.

While not particularly shown in the drawings, it will be understood by those skilled in the art that the disclosed embodiments may be modified within the scope of the present invention to include various features. For example, the embodiments may be modified to include straps or handles for the user's hands or feet. Examples of such straps and handles for other types of stunt performing equipment are shown in U.S. Pat. Nos. 4,619,619; 4,028,761; and 4,929,208, which are hereby incorporated by reference as if fully set forth herein. The upper deck may also be constructed to include a high friction surface to promote grip. Furthermore, the bottom surface of the various embodiments can be formed to include a fin or other structure to provide additional stability.

Turning now to FIGS. 9 through 13, a sixth embodiment of a submersible water toy constructed in accordance with the teachings of the present invention is illustrated and generally identified at reference character 610. For manufacturing and strength considerations, the submersible water toy 610 of the sixth embodiment may be unitarily constructed of foam material. Explaining further, the exterior surface and the core of the submersible water toy 610 are unitarily formed of a common material. In one particular application, the submersible water toy 610 is constructed of ethylene vinyl acetate. As with the prior discussed embodiments, the submersible water toy 610 can be constructed of other suitable materials, including but not limited to expanded polystyrene foam.

The submersible water toy 610 is generally illustrated to include an upper deck surface 612 and a lower surface 614. The submersible water toy 610 additionally includes a pair of generally parallel lateral sides 616 and convexly curved front and rear ends 618 and 620. As with the first embodiment, the front and rear ends 618 and 620 may be angled upwardly as they outwardly extend from a center portion of the submersible water toy 610.

Figure 9:
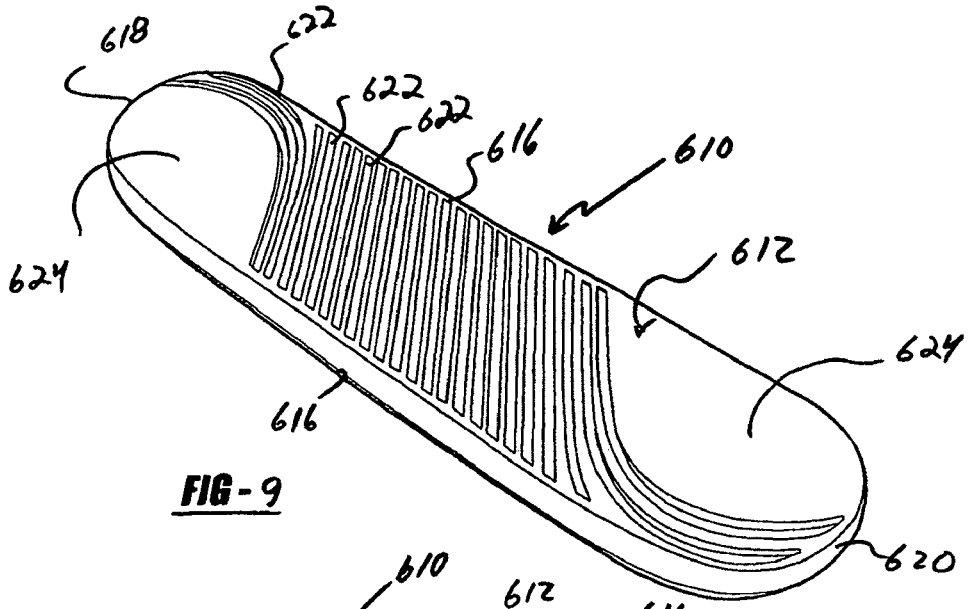
FIG. 9 is a perspective view of a submersible water toy constructed in accordance with the teachings of a sixth embodiment of the present invention.
Figure 10:
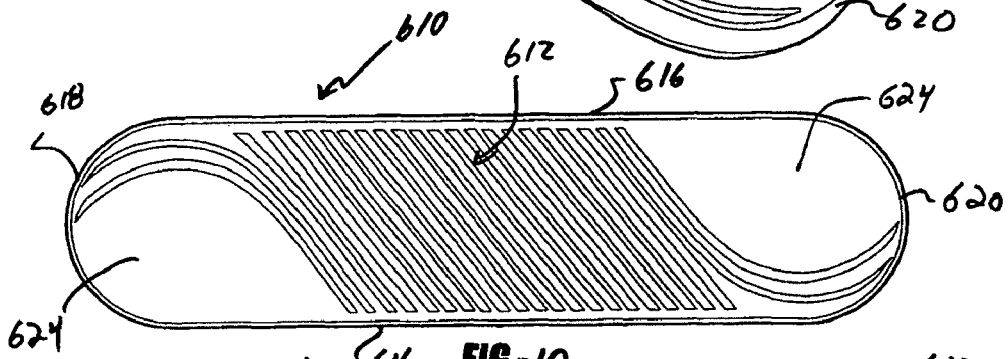
FIG. 10 is a top view of the submersible water toy of FIG. 9.
Figure 11:
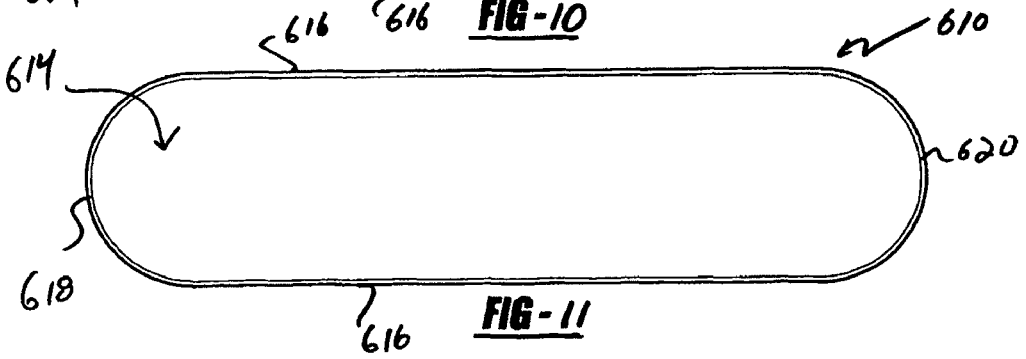
FIG. 11 is a bottom view of the submersible water toy of FIG. 9.
Figure 12:
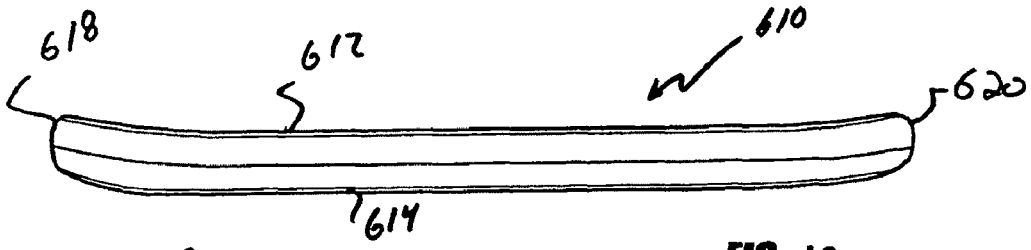
FIG. 12 is a side view of the submersible water toy of FIG. 9.
Figure 13:
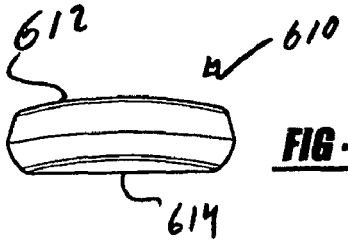
FIG. 13 is an end view of the submersible water toy of FIG. 9.
Figure 14:
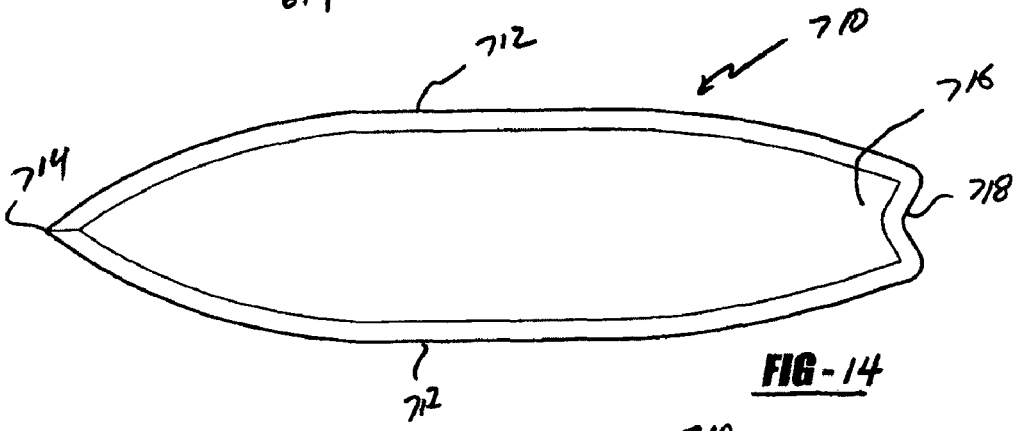
FIG. 14 is a top view of a submersible water toy constructed in accordance with a seventh embodiment of the present invention.
Figure 15:
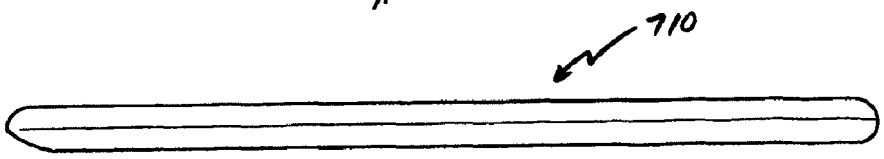
FIG. 15 is a side view of the submersible water toy of FIG. 14.
Figure 17:
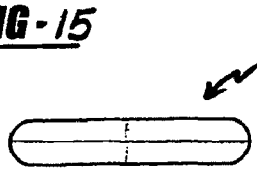
FIGS. 16 and 17 are rear and front end views, respectively, of the submersible water toy of FIG. 14.
Figure 16:
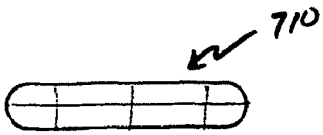

As particularly shown in FIGS. 9 and 10, the submersible water toy 610 generally includes an upper surface 612 integrally formed to include a three-dimensional pattern. In the embodiment illustrated, the three-dimensional pattern includes a plurality of recessed grooves 622 along a central portion of the submersible water toy 610, the grooves 622 extend at an angle relative to the lateral sides 616 and are generally parallel to one another. These parallel grooves 622 provide additional traction for the user. Proximate the front and rear ends 618 and 620 of the submersible water toy 610, the recessed grooves 622 are shown to include arcuate portions similarly improved traction and also aesthetically enhanced the appearance of the submersible water toy 610. These arcuate portions of the recessed grooves 622 partially circumscribe portions 624 of the submersible water toy 610 which may be integrally or otherwise provided with graphics.

According to one particular method of manufacture, the submersible water toy 610 is constructed on a solid piece of ethylene vinyl acetate (EVA). The EVA is provided in a generally rectangular blank having a color dispersed therethrough. The blank is placed within a heated mold for approximated ten minutes. The heated mold includes an upper die having a pattern to create the plurality of grooves 622 in the upper surface of the toy 610. The resulting toy 610 requires no additional finishing steps other than minor trimming. In certain applications, however, it may be desirable to paint logos or other designs on to the toy 610.

Turning now to FIGS. 14 through 17, a submersible water toy constructed in accordance with a seventh embodiment of the present invention is illustrated and generally identified at reference character 710. Similar to the sixth embodiment discussed immediately above, the submersible water toy 710 is unitarily constructed of a foam material. Distinct from the sixth embodiment, the submersible water toy 710 includes convexly curved lateral sides 712 which forwardly terminate at a point 714. Adjacent a rear-end 716, the submersible water toy 710 defines a generally V-shaped notch, 718. As with the sixth embodiment, the submersible water toy 710 may be formed to integrally include a pattern on an upper surface thereof.

The previously described embodiments may also be modified to include an inflatable bladder. Additional air may be introduced into the inflatable bladder to increase the buoyancy of the toy for a particular user or a particular stunt. In certain applications, the inflatable bladder may substantially or completely replace the foam core and thereby provide the main source of buoyancy.

The previously described embodiments may also be modified to include a motor for propelling the toy. One suitable motor is conventionally used to propel scuba divers. The motor may be secured to the toy in a manner well known in the art.

Figure 18:
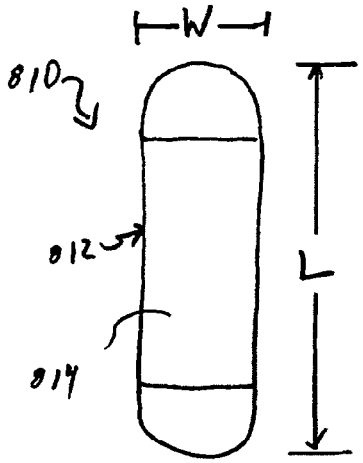
FIG. 18 is a top view of a skim board constructed in accordance with the teachings of an eighth embodiment of the present invention.
Figure 19:
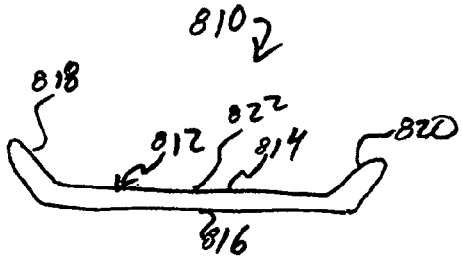
FIG. 19 is a side view of the skim board of FIG. 18.

Turning now to FIGS. 18 and 19 of the drawings, a skim board constructed in accordance with the teachings of an eighth embodiment of the present invention is illustrated and generally identified at reference 810. The skim board 810 is particularly adapted to be ridden by a user on top of the shallow layer of water remaining on a beach immediately after a wave of the ocean recedes. It will be understood by those skilled in the art that the teachings of the present invention are equally applicable for similar water conditions.

The skim board 810 of the eighth embodiment of the present invention is generally illustrated to include a main body portion 812. The main body portion 812 is shown to include an upper surface 814 and a lower surface 816. The upper surface 814 defines a deck portion for directly supporting the feet of the user. The lower surface 816 is supported by the water.

As most particularly shown in FIG. 19, the skim board 810 may include cantilevered front and rear ends 818 and 820 which angle upwardly as they extend from a center portion 822. These angled front and rear ends 818 and 820 provide alternate surfaces for engaging the feet of the user 814 as the user performs various stunts. In the exemplary embodiment illustrated, the front and rear ends 818 and 820 intersect the central portion 822 at sharp angles. Alternatively, the front and rear ends 818 and 820 may gradually transition into the central portion 822 through a curved surface. The skim board 810 of the present invention may be alternatively constructed without these angled front and rear ends 818 and 820.

In certain applications, it may be desirable to cover the top surface 814 with a soft material. One suitable material is ethylene vinyl acetate (EVA). Other materials known in the art may also be incorporated to provide a surface that is soft and easy to grip.

In one particular application, the skim board 810 has a length L of approximately 40 inches and a width W of approximately 20 inches. These dimensions, however, are merely exemplary. In this regard, the dimensions can be modified depending on factors including but not limited to the weight of the intended user; and the particular stunts or tricks intended to be performed on the skim board 810. Based on factors such as these, an optimal design of the skim board 810 provides enough surface area to facilitate sliding of the skim board 810 on top of a shallow layer of water (as per a conventional skim board).

Figure 20:
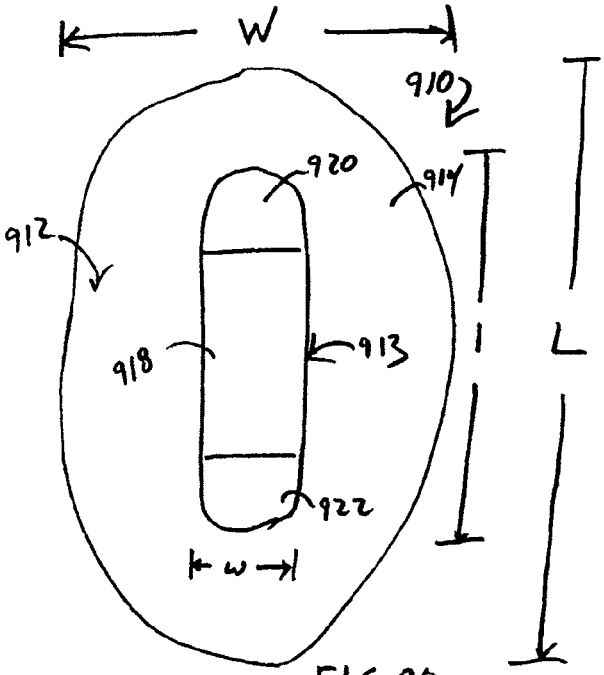
FIG. 20 is a top view of a skim board constructed in accordance with the teachings of a ninth embodiment of the present invention.
Figure 21:
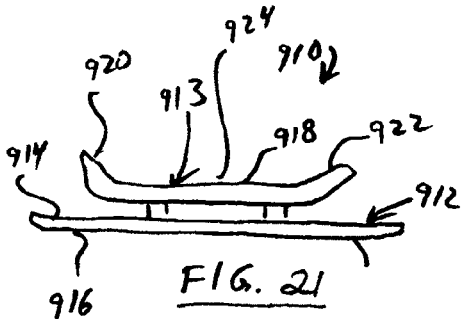
FIG. 21 is a side view of the skim board of FIG. 20.

Turning now to FIGS. 20 and 21 of the drawings, a skim board constructed in accordance with the teachings of the ninth embodiment of the present invention is illustrated and generally identified at reference character 910. Certain features of the skim board 910 are similar to the skim board 810 of the eighth embodiment. Distinct from the eighth embodiment, the skim board 910 of the second preferred embodiment generally includes a lower portion 912 and an upper portion 913. The lower portion 912 is illustrated to be generally planar and have an upper surface 914 and a lower surface 916. The lower surface 916 is generally planar and configured to ride on a shallow layer of water. As is conventional in the art, the forward and rear edges of the lower portion 912 may be upwardly curved or radiused to avoid the skim board 910 from digging into the beach or submarining during use.

The upper portion 913 defines a user supporting portion and upwardly extends from the upper surface 914 of the generally planar lower portion 912. The user supporting portion 913 has an upper surface 918. The area of the upper surface 918 is substantially less than the area of the lower surface 916. The upper surface 918 of the user supporting portion 913 defines an upper deck surface upon which the user can stand or otherwise be supported.

As most particularly shown in FIG. 21, the skim board 910 may include cantilevered front and rear ends 920 and 922 which angle upwardly as they extend from a center portion 924. These angled front and rear ends 920 and 922 provide alternate surfaces for engaging the feet of the user as the user performs various stunts. In the exemplary embodiment illustrated, the front and rear ends 920 and 922 intersect the central portion 924 at sharp angles. Alternatively, the front and rear ends 920 and 922 may gradually transition into the central portion 924 through a curved surface. The skim board 910 of the present invention may be alternatively constructed without these angled front and rear ends 920 and 922.

In the embodiment illustrated, the upper portion 913 is spaced apart from the lower portion 912. Alternatively, the upper portion 913 can be disposed immediately adjacent the lower portion 912. Further in the embodiment illustrated, the upper portion 913 is integrally formed with the lower portion 912. Alternatively, the upper and lower portions 912 and 913 can be independently constructed (possibly of distinct materials) and suitably joined to one another. In certain applications, it may be desirable to removably attach the upper portion 913 to the lower portion 912 so that a conventional skim board can serve as the lower portion 912 and effectively be retrofitted to include the upper portion 913. Such attachment can be done through gluing or any other manner well known in the art.

In one particular application, the generally planar lower portion 912 of the skim board 910 has a length L of approximately 44 inches and a width of approximately 22 inches. In this particular application, the upper portion 913 has a length l of approximately 31 inches and a width w of approximately 8 inches. These dimensions, however, are merely exemplary. In this regard, the dimensions can be modified depending on factors including but not limited to the weight of the intended user; and the particular stunts or tricks intended to be performed on the toy. Based on factors such as these, an optimal design of the skim board 910 provides enough surface area to facilitate sliding of the skim board 910 on top of a shallow layer of water (as per a conventional skim board).

Accordingly, the eighth and ninth embodiments of the present invention provide an upper deck surface for directly supporting a user in a manner similar to a conventional skateboard. The embodiments of the present invention further provide a lower surface to facilitate riding on a shallow layer of water in a manner similar to a conventional skim board. This unique combination provides the user with a toy that can be used for entertainment in a new way that will appeal to users familiar with both skim boarding and skateboarding.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A submersible water toy, comprising:

a core unitarily formed of at least one of an ethylene vinyl acetate foam or an expanded polystyrene foam, the core having a thickness substantially corresponding to a thickness of the submersible water toy in a dimension substantially normal to a surface of water when the submersible water toy is submersed in the water, the core having a length no greater than about 31 inches and a width no greater than about 8 inches, the core having a front end portion, a rear end portion and a central portion between the front end portion and the rear end portion, the central portion having a first edge and a second edge, the first edge being substantially parallel to the second edge, a buoyancy of the core configured to buoyantly support a user in a substantially standing position with the user's feet contacting a surface of the submersible water toy and such that the submersible water toy is entirely submersible.

2. The submersible water toy of claim 1, wherein the core has a three-dimensional pattern on an upper surface of the core, the three-dimensional pattern being configured to increase traction of the upper surface of the core.

3. The submersible water toy of claim 1, wherein the front end portion of the core cantilevered and the rear end portion of the core is cantilevered, the cantilevered front end portion of the core and the cantilevered rear end portion of the core being raised relative to the central portion of the core.

4. The submersible water toy of claim 1, wherein the buoyancy of the core is configured such that the user's feet and at least a portion of the user's legs are submersed when the submersible water toy is submersed with the user in a substantially standing position on the submersible water toy.

5. The submersible water toy of claim 1, wherein the buoyancy of the core is configured such that the user's legs and at least a portion of the user's torso are submersed when the submersible water toy is submersed with the user in a substantially standing position on the submersible water toy.

6. The submersible water toy of claim 1, wherein the buoyancy of the core is configured such that the submersible water toy can be submersed until a bottom surface of the submersible water toy contacts a bottom surface of the body of water.

7. The submersible water toy of claim 1, wherein the front end portion and the rear end portion of the core each have a convexly curved shaped in a top view of the core.

8. A submersible water toy, comprising:

a core unitarily formed of foam, the core having a length along a first dimension, a width along a second dimension transverse to the first dimension and a thickness along a third dimension transverse to the first dimension and the second dimension, the width being greater than the thickness, the length being greater than the width and the thickness, the core including a top surface having a length no greater than about 31 inches and a width no greater than about 8 inches, the core corresponding to a middle portion of the submersible water toy along the third dimension, at least a portion of an upper portion of the submersible water toy along the third dimension and at least a portion of a lower portion of the submersible water toy along the third dimension, the core being configured to be entirely submersed when a user is buoyantly supported and partially submersed in a substantially standing position with the user's feet contacting a surface of the submersible water toy.

9. The submersible water toy of claim 8, wherein the core corresponds to the entire upper portion of the submersible water toy, the submersible water toy further comprising a shell, at least a portion of the shell being disposed within the lower portion of the submersible water toy, a lower surface of the core being disposed between the portion of the shell and the middle portion of the submersible water toy.

10. The submersible water toy of claim 8, wherein the core corresponds to the entire lower portion of the submersible water toy, the submersible water toy further comprising a shell, at least a portion of the shell being disposed within the upper portion of the submersible water toy, an upper surface of the core being disposed between the portion of the shell and the middle portion of the submersible water toy.

11. The submersible water toy of claim 8, further comprising:

a shell having a first portion disposed within the lower portion of the submersible water toy and a second portion disposed within the upper portion of the submersible water toy, a lower surface of the core being disposed between the first portion of the shell and the middle portion of the submersible water toy, an upper surface of the core being disposed between the second portion of the shell and the middle portion of the submersible water toy.

12. The submersible water toy of claim 8, wherein the core has a three-dimensional pattern on an upper surface of the core, the three-dimensional pattern being configured to increase traction of the upper surface of the core.

13. The submersible water toy of claim 8, wherein the core is formed of at least one of an ethylene vinyl acetate foam or an expanded polystyrene foam.

14. The submersible water toy of claim 8, wherein the front end portion of the core is cantilevered and the rear end portion of the core is cantilevered, the cantilevered front end portion of the core and the cantilevered rear end portion of the core being raised relative to the central portion of the core.

15. The submersible water toy of claim 8, wherein the core has a front end portion, a rear end portion and a central portion between the front end portion and the rear end portion, the central portion having a first edge and a second edge, the first edge being substantially parallel to the second edge, the front end portion and the rear end portion of the core each have a convexly curved shaped in a top view of the core.

16. A submersible water toy, comprising:

a core unitarily formed of foam, the core having a length along a first dimension, a width along a second dimension transverse to the first dimension and a thickness along a third dimension transverse to the first dimension and the second dimension, the width being greater than the thickness, the length being greater than the width and the thickness, the core having a length of one of about 29 inches and about 31 inches and a width of about 8 inches, the core corresponding to a middle portion of the submersible water toy along the third dimension, at least a portion of an upper portion of the submersible water toy along the third dimension and the entire lower portion of the submersible water toy along the third dimension, the core having a buoyancy such that the submersible water toy floats when a user is not disposed on the submersible water toy and such that the submersible water toy is entirely submersed when a user is buoyantly supported on a surface of the submersible water toy and the user is at least partially submersed; and a shell, at least a portion of the shell being disposed within the upper portion of the submersible water toy, an upper surface of the core being disposed between the portion of the shell and the middle portion of the submersible water toy.

17. The submersible water toy of claim 16, wherein the core has a front end portion, a rear end portion and a central portion between the front end portion and the rear end portion, the central portion having a first edge and a second edge, the first edge being substantially parallel to the second edge, the front end portion and the rear end portion of the core each have a convexly curved shaped in a top view of the core.

* * * * *